US006351854B1

(12) United States Patent
Whalen et al.

(10) Patent No.: US 6,351,854 B1
(45) Date of Patent: Mar. 5, 2002

(54) PERSONAL PROTECTION DEVICE

(76) Inventors: Thomas J. Whalen, 313 Hills Rd., Nokomis, FL (US) 34275; Brian C. Whalen, 5 Parkside Dr., Montpelier, VT (US) 05602

( * ) Notice: Subject to any disclaimer, the term of this patent is extended or adjusted under 35 U.S.C. 154(b) by 0 days.

(21) Appl. No.: 09/738,440

(22) Filed: Dec. 15, 2000

(51) Int. Cl.[7] ..... A42B 3/00
(52) U.S. Cl. ..... 2/413
(58) Field of Search ..... 2/413, 456, 463, 2/DIG. 3

(56) References Cited

U.S. PATENT DOCUMENTS 3,487,417 A * 12/1969 Morgan
3,713,640 A * 1/1973 Margan
3,877,076 A * 4/1975 Summers et al.
4,142,252 A * 3/1979 Storer
4,566,137 A * 1/1986 Gooding
5,007,111 A * 4/1991 Adams
5,219,368 A * 6/1993 Page
5,235,703 A * 8/1993 Maynard
5,345,609 A * 9/1994 Fabry et al.
5,867,842 A * 2/1999 Pinsley et al.
6,012,162 A * 1/2000 Bullat

* cited by examiner

*Primary Examiner*—Rodney M. Lindsey
(74) *Attorney, Agent, or Firm*—Gifford, Krass, Groh, Sprinkle, Anderson & Citkowski, P.C.

(57) ABSTRACT

A load absorbing apparatus for use in protective equipment in which a resilient bag containing fluid under pressure is disposed in a position subject to loads and a reservoir of elastomeric material which is expandable from an initial position with a minimum volume to a loaded position with an increased volume which is positioned in spaced relation to said position subject to loads. The resilient bag and reservoir are connected in fluid communication so that loads imposed on the bag force fluid from the bag to the reservoir where the energy is dissipated. After the load is removed from the resilient bag, the reservoir returns to its original shape to return the fluid to the resilient bag. The protective equipment incorporating the load absorbing apparatus can be in the form of a helmet with a relatively rigid shell or a body protected pad having a flexible outer cover.

6 Claims, 3 Drawing Sheets

PERSONAL PROTECTION DEVICE

FIELD OF THE INVENTION

This invention relates to personal protection devices incorporating impact and load absorbing mechanism of a type that can be used in equipment for giving protection and comfort to a user and more particularly to systems used in protective gear such as helmets and body protectors.

BACKGROUND OF THE INVENTION

As force is applied to the body of a human the body will begin to experience discomfort at some level of force. When used to counteract this level of force, load-absorbing devices are used to improve comfort. As the level of applied force increases, a force is reached beyond which damage to the body occurs. Impact-absorbing devices are used to absorb such forces and afford bodily protection.

The functional principals operative in this field include: (1) absorption of the energy of the applied force at the point of impact, (2) distribution of absorbed energy throughout a larger volume or area of impact cushioning material, (3) dissipation of the energy of the impact force through the structure of the cushioning material by kinetic thermal or chemical means, and (4) release of the absorbed and distributed energy at a slower rate and lower level of intensity to the surrounding structures including the underlying portions of the body.

Typical constructions of such devices for personal comfort and protection include an external layer and an internal layer. The external layer is useful to protect the internal layer from direct damage resulting from the external force. The external layer may be pliable and durable as in a chest protector or it may be rigid and durable as in a helmet construction. Typically the external layer does not absorb a large percentage of the impacting energy into its own structure but serves to distribute the energy of applied force over a larger surface area of the internal structure. The internal layer, often referred to as the cushioning layer, absorbs, distributes and dissipates the energy of the impact force.

In the past many materials have been used to provide the internal cushioning layer depending on whether or not the external area is rigid or non-rigid. Examples of protective equipment having a rigid external layer include helmets, shoulder pads and shin pads. Examples of protective equipment with non-rigid external layers would be chest protectors and hockey goalies leg pads.

Foam cushioning has been used for many years as an energy absorbing internal layer. It has been used as the sole component of this layer and has also been used in combination with other energy absorbing materials such as woven straps or air-filled chambers as found in U.S. Pat. No. 3,994,022 to Villari et al and U.S. Pat. No. 5,014,365 to Schultz. Major problems with foam type energy absorbing structures are that: (1) the energy is not easily distributed throughout the structure and therefore force of impact must be absorbed within the immediate locale of the impact, (2) the foam is relatively easily deformed to the extent that the maximum energy which can be absorbed is reached quickly with any further energy transferred directly from the rigid shell to the underlying anatomical structures, sometimes referred to as "bottoming out", (3) the recovery profile, the time required for the energy absorbing structure to return to its original state following an impact, may be such that it is inefficient at absorbing repeated impacts, and (4) repeated impacts may cause fatigue and a break down of the energy absorbing structure of the foam thereby diminishing its efficiency.

Fluid filled chambers have been used as energy absorbing internal layers for protective helmets. Some designs are used in combination with foam cushions as shown in U.S. Pat. No. 4,375,108 to Gooding. Also certain other designs utilize multiple isolated chambers containing gas located separately within a rigid shell as disclosed in U.S. Pat. No. 4,586,200 to Poon. Additionally, there are designs of gas filled chambers, which are in communication with each other such that gas may flow from one chamber to the next. The flow of gas from one chamber to the next theoretically can be unrestricted but in practice, flow is restricted by the internal geometry and composition of the structure that connects the chambers and the resistance of the adjacent chamber to accept additional gas as well as any external pressure subsequently applied to the second chamber. This is exemplified by the previously mentioned patents to Schulz and Gooding. The flow of gas from a first chamber to a second chamber may be intentionally restricted by connecting structures incorporating valves or crimped mechanisms which serve to impede gas flow as seen in U.S. Pat. No. 4,566,137 to Gooding or U.S. Pat. No. 4,038,700 to Gyory.

In all prior art helmet structures, gas filled chambers are located within the structure of the rigid external layer. In essence these are all closed cell systems within the confines of a rigid shell. Such closed cell systems present certain problems. For example, the energy of the impact force must be absorbed and dissipated within the local or immediately contiguous area, as the energy is not distributed evenly throughout the helmet. Additionally, if the initial force is applied over a large area, or more than one force is applied at separate locations, the energy may not be able to be distributed at all from one region to a second region thus increasing the likelihood of transfer of energy to the underlying body which is to be protected. Also, in the unrestricted flow situation, all of the gases may be emptied from a chamber allowing further energy to be transferred to the underlying anatomical structures. In the case of chambers with restricted flow the energy is more likely to be transferred to the underlying anatomical structure. In any of these designs, the initial force may exceed the structural capabilities of the chamber causing it to rupture. Where any flow of gas between chambers is allowed, the recovery profile of any individual chamber is unclear, increasing the likelihood that more energy from repeated impacts will be transferred to the underlying structure.

As energy-absorbing characteristics of the foregoing helmet systems are exceeded, the energy is transferred to the underlying structures, such as the skull or brain. This transfer of energy is non-linear, defined by a more complex equation in which small increases in external force produce ever-larger increases in the energy transferred to the head. This is not unlike the changes that occur inside the skull following a closed head injury. Small increases in brain swelling are able to be tolerated with little change in intra-cranial pressure until the enclosing structure of the skull is filled or "bottomed out". After that capacity is filled, small increases in brain volume produce ever-larger increases in intra-cranial pressure with dire consequences.

With respect to devices, which have a non-rigid external layer such as body protectors including chest guards, the external layer is usually durable and pliable. It is used to protect the internal cushioning layer from damage, by abrasion and cuts for example. It also may be intended to flex as the body of the user flexes. The internal layers of these devices have been constructed of foam material, fibers such as cotton, gas filled chambers and liquid filled chambers. Examples can be found in U.S. Pat. No. 3,999,220 to Keltner, U.S. Pat. No. 3,995,320 to Zafuto, U.S. Pat. No. 4,453,271 to Donzis, and U.S. Pat. No. 5,235,703 to Maynard. Gas filled chambers have the advantage of being lightweight and are able to conform easily to the anatomical shape of the user. Such structures as used in the prior art may employ gas filled chambers with either communicating chambers or non-communicating chambers and share the problems of energy transfer and unstable recovery profiles as discussed above.

SUMMARY OF THE INVENTION

It is an object of the invention to provide protective equipment incorporating load-absorbing mechanisms to improve the comfort of the user at levels of force below forces which might cause injury and to protect the body of the user from injury due to higher levels of force.

Another object of the invention is to provide protective equipment incorporating fluid filled load-absorbing elements in the area of the expected loads and in fluid communication with reservoir bladders located remotely from the impact areas to absorb and dissipate energy away from the impact area.

The objects of the invention are attained by a load or impact absorbing system incorporating a resilient, flexible bag containing fluid such as air under pressure which is placed in a position between the user and the probable load or path of impact. The bag communicates through a fluid conduit with a resilient reservoir of elastomeric material, having a collapsed condition at rest and which resists inflation until a predetermined pressure is exceeded within the load-absorbing bag. As this pressure is exceeded fluid is transferred from load absorbing bag via the conduit into the reservoir. As the external force is removed, the reservoir collapses to exhaust fluid and return it to the load-absorbing bag upon termination of the impact load. Single or multiple load absorbing systems may be employed in protective equipment such as helmets or chest protectors.

DETAILED DESCRIPTION

Figure 1:
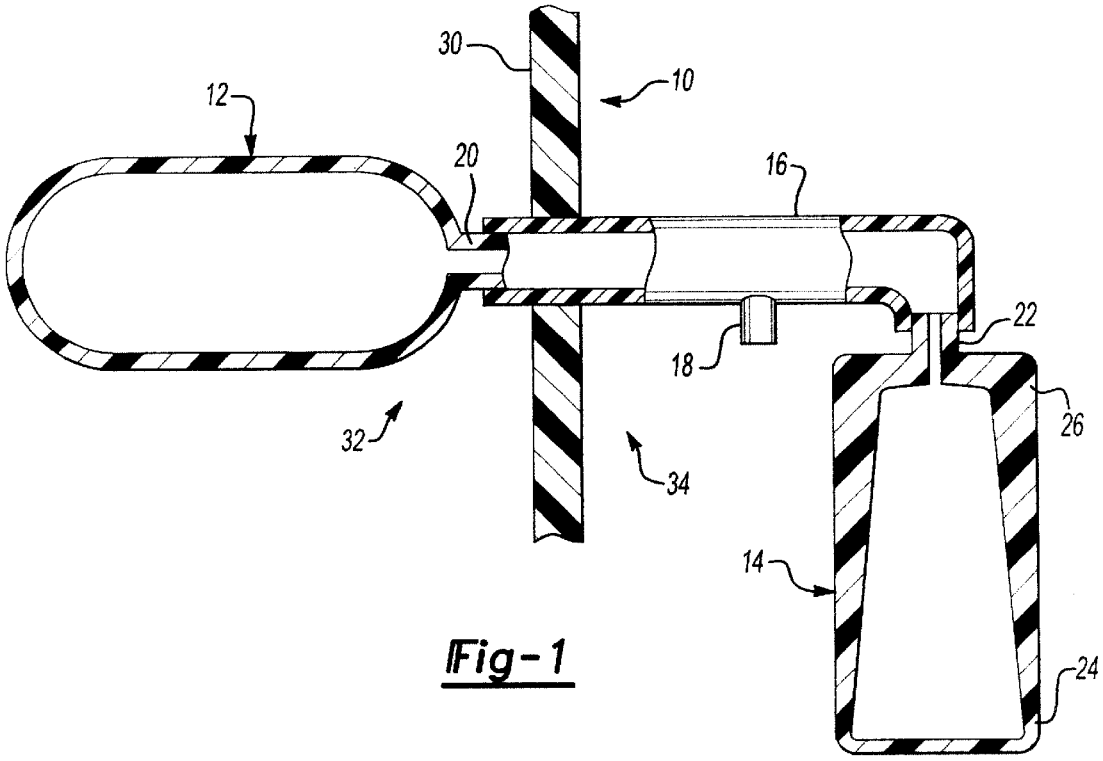
FIG. 1 is a diagrammatic view of the basic components of a load or impact absorbing system embodying the invention.

The load-absorbing system embodied in the present invention is designated generally at 10 in FIG. 1 and incorporates a load or impact-absorbing unit 12 in the form of a resilient bag containing gas under pressure and a reservoir member 14 communicating with the impact-absorbing unit 12 by means of a conduit 16. The conduit means incorporates a valve 18 by which the impact-absorbing unit can be initially inflated with gas, such as air.

The resilient bag 12 may be of a variety of shapes and sizes and is depicted diagrammatically in FIG. 1 as being elongated. The impact-absorbing unit 12 is formed of fluid impervious, durable, flexible material having a port 20 for communicating with the interior of the bag 12 and connected to the conduit means 16.

The reservoir or bladder 14 is illustrated in FIG. 1 as generally tubular although it can be of other shapes and sizes to form a closed bag-like structure made of elastomeric material, which is gas impervious, durable and flexible and having a port 22 for connecting the interior of the bladder 14 to the conduit means 16.

In its collapsed condition, the reservoir bladder 14 is adapted to resist any change in shape at the initial pressure to which the impact-absorbing unit 12 has been inflated. One manner by which this can be accomplished is by controlling the thickness of the walls of the bladder so that it resists increases in internal pressure up to some predetermined level at which the walls begin to stretch and expand. To avoid the reservoir from expanding abruptly, the wall thickness of the reservoir can be varied or tapered to increase gradually from a minimum at one end 24 to a major thickness at the other end 26. On the transfer of gas pressure from the impact-absorbing unit to the reservoir, the reservoir will begin to stretch first in the area at one end 24 having the thin wall and gradually progress to the thicker wall sections as the pressure increases.

To initiate the system, the load-absorbing bag 12 is filled with gas, such as air, through the filler valve 18 communicating with the conduit 16. The initial pressure may vary from a low level sufficient to form the bag 12 up to a maximum pressure below the pressure at which the reservoir 14 will begin to change shape. By way of example, such a maximum pressure could be to the order of 15 p.s.i.

The conduit 16 is made of material to withstand the pressures that the system will be subjected to without cross-sectional distortion. However, the conduit 16 can be flexible to facilitate routing between bag 12 and reservoir 14. The conduit system 16 incorporates the filler valve 18 which can be in the form of a one way check valve of the type used in inflatable automotive or bicycle tires. Also, if desired the conduit 16 can be fitted with flow control valves or restrictions (not shown) to regulate the rate of change of volume of the associated impact absorbing bags during deflation or re-inflation.

A wall 30 is also designated in FIG. 1, which forms a separation between an impact or load absorbing area designated at 32 at the left side of the wall 30 as viewed in FIG. 1 and an area not subject to impact or loads designated at 34 at the right side of the wall 30. Conduit 16 passes through the wall 30 for the purpose of conveying gas from the bag 12 when it is subject to a load or an impact which forces gas from the bag through the conduit 16 to reservoir 14. Similarly, upon termination of the load on the bag 12, the reservoir returns to its normal shape to return gas to re-inflate the bag 12.

Figure 2:
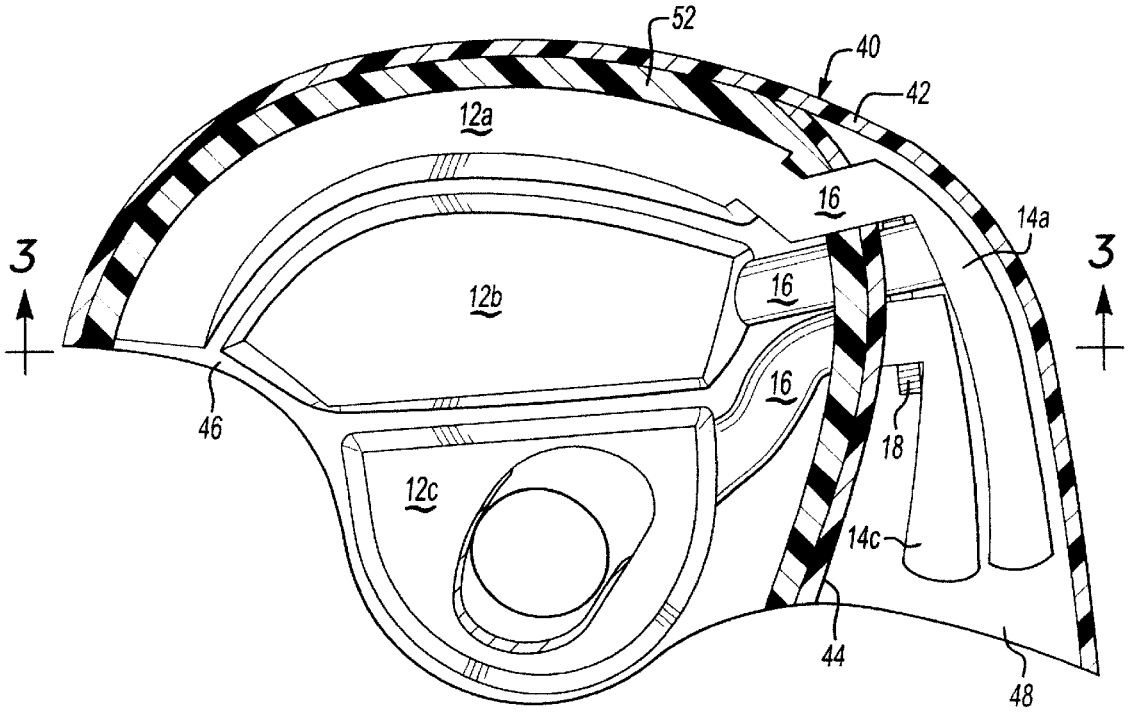
FIG. 2 is a cross-sectional elevational view of a helmet incorporating the load absorbing system of the present invention taken on line 2—2 in FIG. 3.
Figure 3:
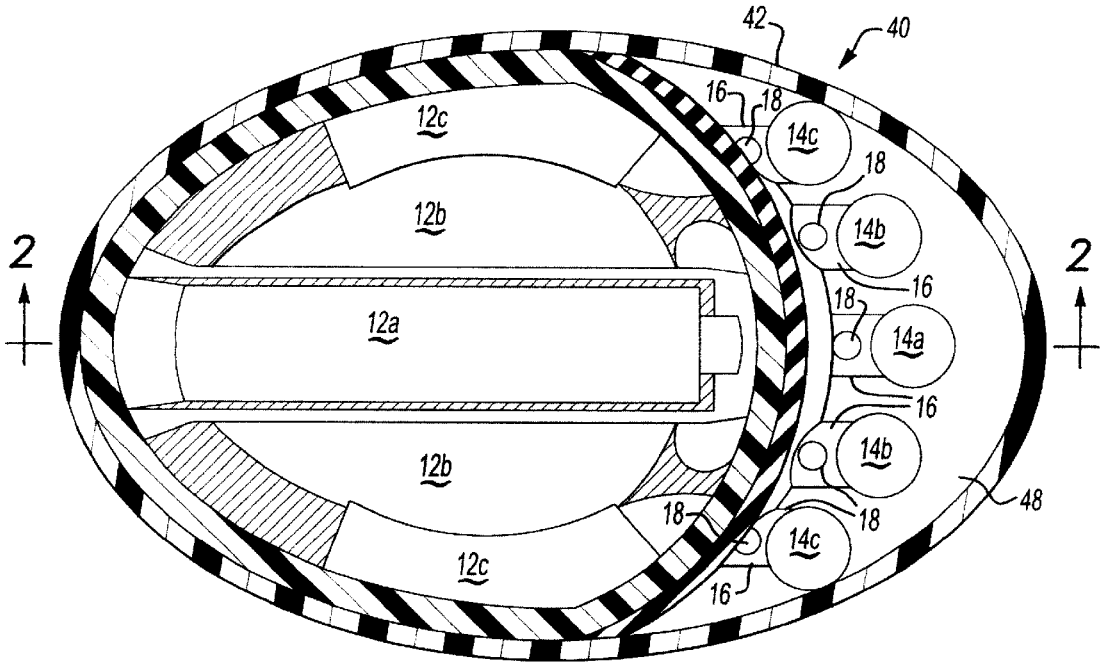
FIG. 3 is a cross-sectional view taken on line 3—3 in FIG. 2.

The system shown in FIG. 1 can be embodied as a single unit, in multiple units, or in variations thereof in a variety of protective equipment. The utilization of multiple impact absorbing systems 10 is shown incorporated in the protective helmet 40 in FIGS. 2 and 3.

Helmet 40 includes an outer shell 42 of rigid material such as plastic. The interior of shell 42 is divided by a generally transversely extending wall 44, which is formed integrally with the outer shell 42 and divides the interior into a head receiving compartment 46 and a separate compartment 48 at the rear of the helmet 40 and at the rear of the head of the wearer. The separate compartment 48 can be considered as an area which is not expected to be subject to loads or impacts.

The head compartment 46 can be lined with a layer of foam 52 to cover all of the interior surfaces of the head-receiving cavity 46. The head cavity 46 is further lined with impact or load absorbing bags in the form of an elongated central bag 12*a,* a pair of intermediate bags 12*b* at opposite sides of bag 12*a* and another pair of bags 12*c* adjacent to bags 12*b* to cover the ear area of the head of a wearer. The rear of the cavity 46 also can be covered with a separate bag to protect the rear of the head or the five bags 12*a,* 12*b,* and 12*c* can be extended to cover the same general area as covered by the layer of foam 52. This has been omitted from the drawings to the interest of simplifying the drawings. All of the bags are closely adjacent to each other. Each of the bags 12*a,* 12*b,* and 12*c* communicate with a separate reservoir 14*a,* 14*b* and 14*c,* respectively, located in the compartment 48. The bags and reservoirs are placed in communication with each other by conduit members 16, which pass through openings in the wall 44. The reservoirs 14*a,* 14*b* and 14*c* can all be of the same size and configuration or can be of a size conforming to the volume of the bags 12*a* through 12*c,* respectively, to which they are connected.

The filler valves 18 associated with each of the conduit members 16 and are disposed within the rear compartment 48. Access to the valves 18 is afforded through the bottom opening 56 to the compartment 48.

The load or impact absorbing unit's 12*a,* 12*b,* and 12*c* may require initial inflation to various volumes and pressures to ensure adequate fit and comfort of the helmet.

Loads imposed on a helmet may be applied from different directions and over a relatively large surface area of the outer shell 42. The load is transferred from the outer shell 42 to one or more of the bags 12*a,* 12*b* or 12*c* and the compression of the bags due to the load causes air to be transferred by way of the conduit members 16 to the reservoirs 14*a,* 14*b* and 14*c* which are located remotely from the impact area. This makes it possible for the energy to be rapidly absorbed by the reservoir units since there is little or no restriction on their expansion in the compartment 48.

Figure 4:
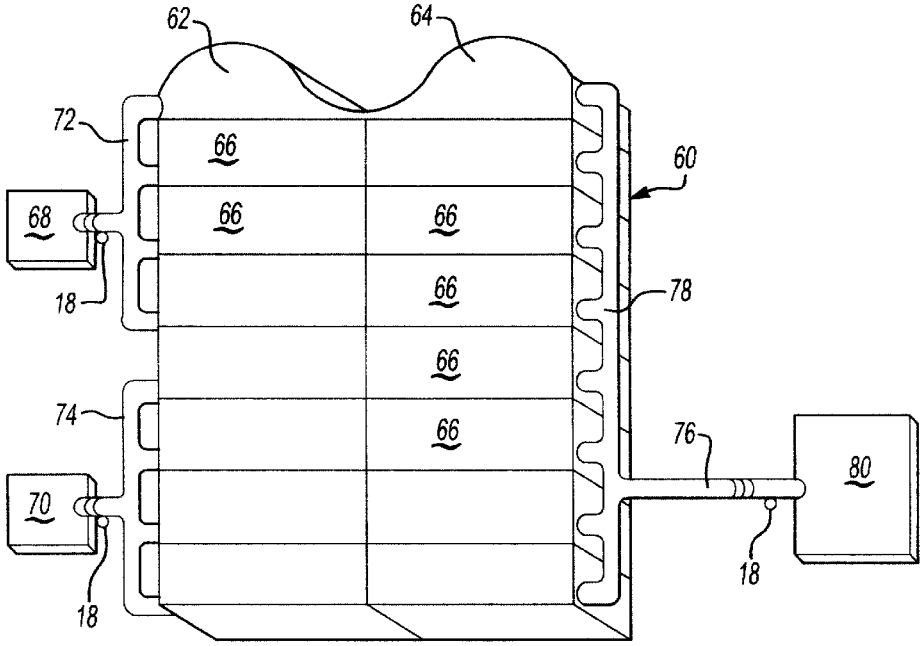
FIG. 4 is a diagrammatic view of a chest protector incorporation the load and impact absorbing systems of the present invention.

The load or impact absorbing system 10 of the present invention can be incorporated also in other protective gear such as a chest protector 60 seen in FIG. 4. The protective garment 60 includes load or impact absorbing systems or bags 62 and 64 disposed at opposite sides of the neck and to overly the shoulders of the wearer of the chest protector. A plurality of identical load absorbing units 66 are arranged in adjacent relationship to each other. The units 62, 64 and 66 can be fastened to each other as by welding or adhesive, or can be detachably fastened to each other as with hook and loop fasteners. As viewed in FIG. 4, the left column of impact absorbing units 62 and 66 are connected to impact absorbing reservoirs 68 and 70. The upper four bags 62, 66 are connected through the manifold system 72 to the reservoir 68 and a lower four bags 66 are connected through a manifold 74 to reservoir 70. In this manner a single reservoir unit accommodates four load or impact absorbing units. By way of another example, all of the impact absorbing bags 64, 66 at the right of the chest protector 60 seen in FIG. 4 are connected through a conduit member 76 and manifold 78 to a single load-absorbing reservoir 80. Inflation valves 18 are shown in association with the manifold 72, 74 and conduit member 76 so that all of the impact or load absorbing units associated with a particular manifold 72, 74 or 78 are inflated to the same pressure.

Since a chest protector usually need only provide protection from a single ball multiple impact absorbing units can communicate with a single reservoir unit. Also, since the connecting conduit members 18 can be of any length, the reservoir bladders can be positioned at a distance from the impact-absorbing bag.

In a chest protector and comparable protective apparatus such as riding pants, shin guards, goalie leg pads, a possible load or impact is expected in a localized area so that a lesser number of reservoir bladders than impact or load bags can be utilized.

Figure 5:
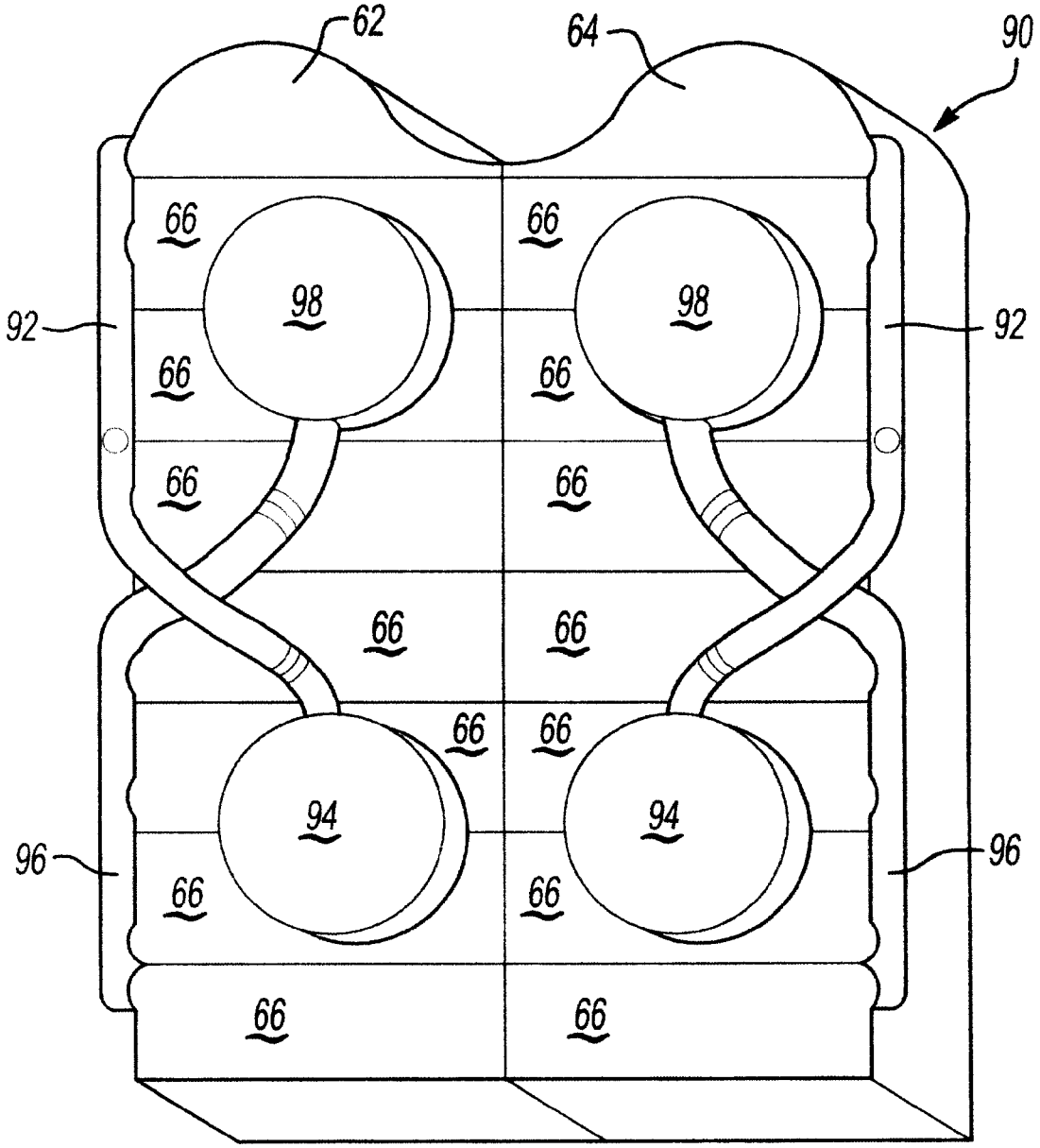
FIG. 5 is a diagrammatic view of another form of chest protector incorporating the load and impact absorbing system of the present invention.

Another embodiment of a chest protector is illustrated in FIG. 5 and designated at 90. As with the unit in FIG. 4 chest protector 90 has impact absorbing units 62, 64 and 66 arranged in two columns as in the FIG. 4 embodiment. The upper four impact-absorbing units in each column are connected through a manifold 92 to a reservoir absorbing member 94 located adjacent to but separate from the lower four impact absorbing units 66. Similarly, a manifold 96 connects the lower four bags 66 in each column to an impact absorbing reservoir 98 located adjacent to the upper impact absorbing units 62, 66. In this case, the placement of the impact-absorbing reservoirs can be closely adjacent to but separate from the impact bags 66 because on receiving a localized impact or load, the fluids in the loaded bags are transferred to reservoirs 94 or 98 in areas remote from the area of impact.

The body or chest protector 90 has an outer covering 92 of durable material which can be flexible to better accommodate body differences and movement. The chest protector 60 should also have a similar covering, which is not shown.

A load absorbing system for use in personal protective equipment has been provided in which a resilient bag under fluid pressure is located in an area where loads may be experienced so that imposing a load results in distortion of the bag to reduce its volume and transfer fluid to a reservoir which is remote from the resilient bag and absorbs the energy of impact or load. Upon removal of the load, the reservoir returns fluid to the resilient bag so that it and the reservoir return to their original shape and condition.

We claim:

1. Personal protective equipment in the form of a helmet comprising;

a substantially rigid outer wall formed by said helmet;

a first area subject to loads;

a second area spaced from said first area and not subject to loads;

load absorbing apparatus including a resilient bag containing fluid under pressure disposed in said first area for receiving loads;

a reservoir of elastomeric material expandable from an initial condition in which its volume is at a minimum to a loaded condition in which its volume is increased, said reservoir being disposed in said second area;

conduit means of fixed cross section placing said resilient bag in fluid communication with said reservoir whereby said reservoir receives fluid in response to an increased load on said resilient bag and collapses to return said fluid to said resilient bag upon a reduction of load on said resilient bag; and wherein said helmet forms a first compartment in said first area to receive the head of a user and a second compartment in said second area adjacent to but separate from said first compartment.

2. The protective equipment of claim 1 wherein said second compartment is to the rear of said first compartment.

3. The protective equipment of claim 1 wherein a plurality of resilient bags are disposed in said first compartment and a plurality of reservoir members are disposed in said second compartment, each one of said reservoir members being in communication with one of said resilient bags.

4. The protective equipment of claim 1 further comprising a filler valve for introducing fluid under pressure to said conduit means.

5. The protective equipment of claim 1 wherein said reservoir is elongated and has walls varying in thickness from one end to the other whereby said reservoir expands gradually at the wall having minimum thickness to the wall having a maximum thickness upon receiving fluid under pressure from said first fluid container in response to a load.

6. The personal protective equipment of claim 1 including a plurality of load absorbing members and wherein said load absorbing members are all connected to a reservoir member disposed remotely from said load absorbing member.

* * * * *